US006161482A

United States Patent [19]

Clark

[11] Patent Number: 6,161,482

[45] Date of Patent: Dec. 19, 2000

[54] MULTI-DISK SHELL AND WAD

[76] Inventor: George D. Clark, P.O. Box 3821, Kingman, Ariz. 86402

[21] Appl. No.: 09/135,697

[22] Filed: Aug. 18, 1998

[51] Int. Cl.[7] ..... F42B 7/08

[52] U.S. Cl. ..... 102/532; 102/451; 102/449; 102/464

[58] Field of Search ..... 102/451, 453, 102/450, 461, 532, 455, 449

[56] References Cited

U.S. PATENT DOCUMENTS

| | | | |
|---|---|---|---|
| 341,586 | 5/1886 | Libbey | 102/532 |
| 1,244,046 | 10/1917 | Ffrench | 102/494 |
| 1,872,102 | 8/1932 | Bond | 102/532 |
| 3,053,185 | 9/1962 | Oberfell et al. | 102/532 |
| 3,191,534 | 6/1965 | Vecchiotti | 102/532 |
| 3,285,174 | 11/1966 | Moehlman et al. | 102/451 |
| 3,402,664 | 9/1968 | Cramer | 102/451 |
| 3,626,854 | 12/1971 | Brooks | 102/464 |
| 3,662,683 | 5/1972 | Merritt | 102/451 |
| 3,721,194 | 3/1973 | Weston, Jr. | 102/451 |
| 3,730,095 | 5/1973 | Lage | 102/451 |
| 3,750,579 | 8/1973 | Bellington | 102/451 |
| 3,762,329 | 10/1973 | Mawhinney | 102/449 |
| 3,796,157 | 3/1974 | Anderson | 102/451 |
| 3,812,784 | 5/1974 | Herter | 102/451 |
| 3,951,040 | 4/1976 | Ziemba | 89/14.05 |
| 4,151,799 | 5/1979 | Jackson | 102/451 |
| 4,162,645 | 7/1979 | Abbott | 86/23 |
| 4,290,365 | 9/1981 | Dreyer | 102/449 |
| 4,587,905 | 5/1986 | Maki | 102/430 |
| 4,829,904 | 5/1989 | Sullivan | 102/439 |
| 4,913,054 | 4/1990 | Petersen | 102/439 |
| 5,429,054 | 7/1995 | Topping | 102/458 |
| 5,648,637 | 7/1997 | Clark, III | 102/438 |

FOREIGN PATENT DOCUMENTS

| | | | |
|---|---|---|---|
| 1548296 | 12/1968 | France | 102/449 |
| 2372411 | 7/1978 | France | 102/449 |
| 1172577 | 6/1964 | Germany | 102/449 |
| 645353 | 9/1962 | Italy | 102/449 |
| 683690 | 2/1965 | Italy | 102/449 |

*Primary Examiner*—Michael J. Carone
*Assistant Examiner*—Son T. Nguyen
*Attorney, Agent, or Firm*—The Halvorson Law Firm, P.C.

[57] ABSTRACT

The present invention is a multidisk shell and wad for use in a multidisk shell. The wad consists of a wad base, a cushioning section attached at a first end to a top section of the wad base, and at least three alignment arms attached to a second end of the cushioning section. The cushioning section is interposed between the projectile mass and the wad base. The preferred cushioning section comprises a hollow outer cylinder and at least one inner cylinder of polymeric plastic material. Thus, there are at least two concentric cylinders providing the cushioning between the disks and the expanding propellant charge. These at least two concentric cylinders and are attached at first ends to the top side of the wad base. The wad has at least three spatially separated alignment arms having proximal ends and distal ends for maintaining the alignment of projectiles as they travel through the gun barrel. The maintenance of projectile alignment is helpful in reducing the scatter of the projectiles after they exit the gun. The at least three alignment arms are typically attached at the proximal ends to a second end of the cushioning section. The geometry of the at least three alignment arms is useful in the maintenance of the alignment of the projectile under acceleration. A preferred embodiment is a totally symmetrical configuration. Thus when the wad contains three alignment arms the arms are spaced at regular intervals of 120 degrees; four alignment arms are separated by 90 degrees; etc.

12 Claims, 9 Drawing Sheets

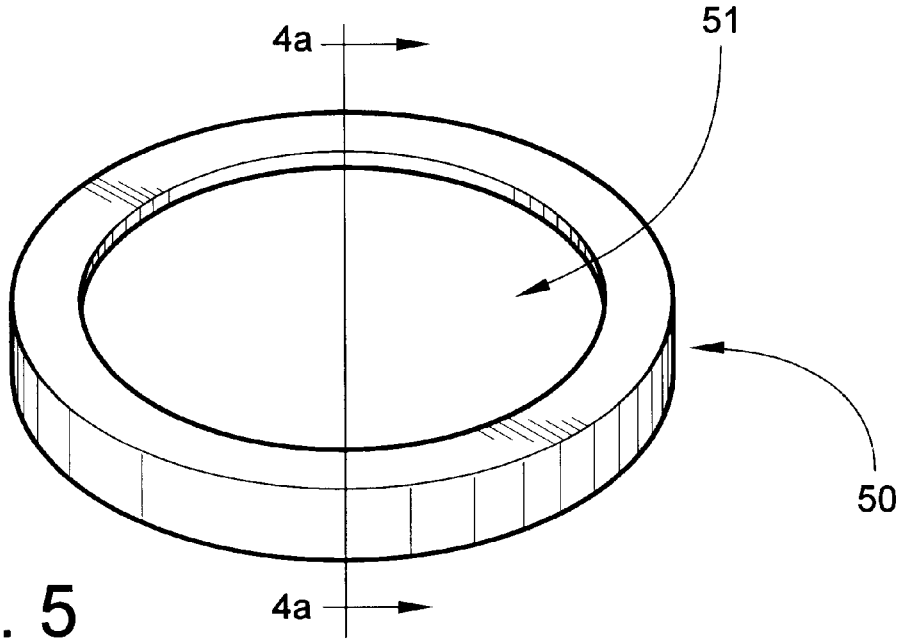
Fig. 5
Fig. 6a
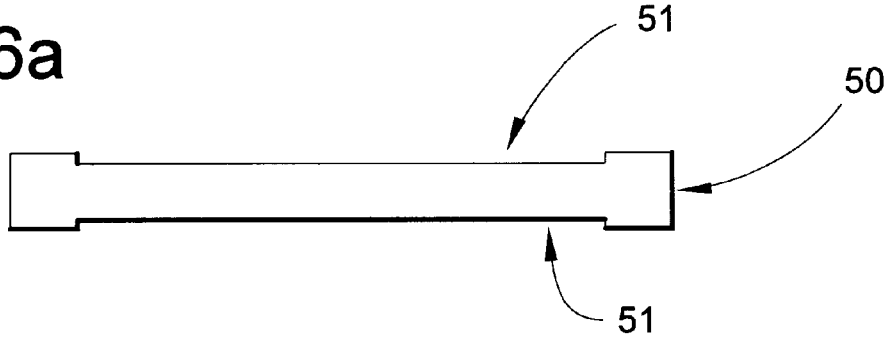
Fig. 6b
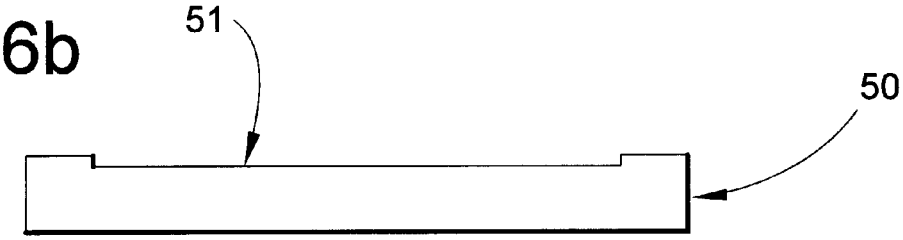

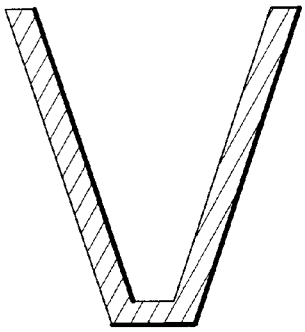
Fig. 11a
Fig. 11b
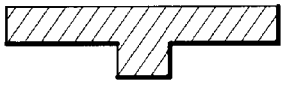
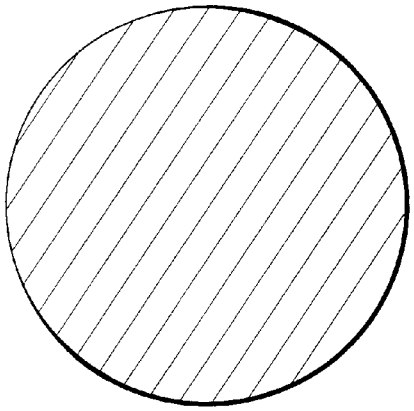
Fig. 11c

MULTI-DISK SHELL AND WAD

BACKGROUND OF THE INVENTION

1. Field of the Invention

The invention relates in general to firearms, and more specifically to the construction of multi-projectile ammunition and wads that are interposed between ammunition propellant and ammunition projectiles.

In one embodiment, a more or less conventional shotgun shell, instead of having the conventional plurality of spherical pellets or shot contained therein, carries a plurality of stacked disks that can spread on firing to effect a greater stopping power on a target, i.e., each disk will impact on a larger area and, collectively, yield a greater total momentum on striking the target.

In alternative embodiments, the disks are frangible and, upon impact, shatter and inflict greater damage, including wound and trauma damage upon the target without adversely affecting the striking momentum. The use of either solid or frangible disks has a multitude of anti-personnel applications.

In addition to a plurality of stacked disks for use as projectiles, an embodiment of a new shotshell wad for protecting projectiles during the initial acceleration spike is comprised primarily of at least two concentric hollow cylinders longitudinally interposed between the projectiles and the propellant. These multiple concentric cylinders effectively cushion the multiple disks and prevent damage during the firing of the shell.

Alternative embodiments of the wad of this invention contain alignment arms useful for guiding the multiple disk projectiles though the shell casing and the gun barrel and preventing frictional power loss due to contact between the projectiles and the gun barrel.

2. Related Art

A great variety of frangible shells have been designed that, when fired from a gun or cannon or dropped, as with a bomb in the form of a single shell, carries an explosive charge that explodes during flight, to fragment the shell into a multitude of individual components either during flight, or upon firing of a timed fuse, or, alternatively, explodes on impact with a target.

One such device is disclosed in the Drake patent, U.S. Pat. No. 109,600, wherein the interior of a projectile was scored in such manner such that when the enclosed charge was ignited, the single missile would break up into a multiple of parts flying in all directions described by the scoring, with few, if any, in the direction of travel or the forward target. In the Rice patent, U.S. Pat. No. 216,974, a single projectile bullet in axial segments had a separate head. On firing, the head separated and the axial segments were caused to fly apart in the air due to resistive air forces operating on a concave tip on the leading edge of the segments. The small axial segments flew in a conical format in the direction of travel of the main bullet to do additional damage to a target but had little or not "stopping" power.

The patent for Ffrench, U.S. Pat. No. 1,244,046, disclosed a projectile containing a plurality of stacked apertured metal disks that possessed a variety of slots to facilitate fragmentation thereof on impact. Such disks, however, were carried by a fired shell to a position above a target. After a predetermined interval had elapsed, a fuse in the shell detonated a charge, dispersing the disks rearward and downward to rain on personnel below.

The Sweeley patent, U.S. Pat. No. 2,343,818, discloses a conventional shot gun shell with a plurality of stacked cylinders contained therein which disperse on firing and yield a greater stopping effect on a target at a greater distance than conventional small pellets. However, due to the necessarily small number of such cylinders and the relatively small diameter of each cylinder, the stopping power is diminished because of the ease of penetration into the target and the slower release of energy.

U.S. Pat. No. 2,413,008, to Taglialetela, teaches a fragmentation bomb having a plurality of stacked annular "anvils" all inclined in the same direction to effect a concentrated umbrella fragmentation pattern upon explosion of the bomb. The disclosure of Sylwester, U.S. Pat. No. 3,720,168, showed a shaped charge missile warhead with a plurality of stacked elliptical disks inclined at a common angle with high explosive disposed between the disks. On detonation, the inclined disks and missile body effected a shaped charge in a single direction against, for example, ground troops.

In a later development of Henderson, in U.S.S.I.R. H1047, a fragmentation type bomb was designed with a warhead using notched rods. On detonation, the bomb shell and the notched rods fragmented into a plurality of similar shaped and sized particles that flew in all directions but could not be directed in a specific direction.

In the related art, there are described multiple component shells or missiles that separate after firing, as a result of an explosive charge carried by the missile. Most of these disclosures deal with fragmentation bombs and shells. Rice, however, teaches a separable bullet that separates, in part to cause additional damage to a target but with little attention paid to stopping power, a primary concern of the present invention.

Ffrench, on the other hand, discloses a bomb or missile with multiple frangible disks designed to separate in mid air on detonation only. This is primarily an anti-personnel weapon that is designed to fall on troops in trenches below, with no thought to stopping power.

The Sweeley shotgun shell provides fewer projectiles, but of larger size to provide a compromise between the stopping power of a single projectile and the wider impact area of a shotgun charge. Stopping power is an expressed concern of the present invention that seeks to provide such stopping power.

It has long been deemed desirable to have a device that could provide greater short range stopping power on a target by providing for the quick release of energy upon impact. The quicker the energy release, the greater the shock impact upon the target. It is well known that larger caliber weapons are capable of providing substantial "stopping power". However, because of the relative sizes of the single projectile and target, there is some concern with accuracy since a relatively small projectile must strike the target within a limited area of effectiveness.

Shotguns are used to deploy a large number of projectiles with a wider area of impact. However, each of the projectiles carries only a small part of the energy of the load and therefore, because of their large number and small size, loses energy during flight and cannot deliver the same impact to a target. Shotgun shells can be loaded with fewer projectiles of larger size. However, there yet remains a long standing need for a weapon with substantial stopping power over a wide area of impact to reduce the need for great accuracy in aiming.

In large bore weapons, there is typically a wad interposed between the propellant and the projectile. This wad serves a multiple of purposes, primary among these is a sealing action provided to an area forward of the propellant gasses, thus enhancing the acceleration due to the combustion of propellant. It also acts as a buffer between the propellant and the projectile(s). The cushioning of the wad typically is relatively minor.

The Gardner patent, U.S. Pat. No. 5,347,932, discloses a wad containing a hinge portion between the shot cup and the propellant cup. This hinge portion compresses upon combustion of the propellant much in the manner of a pair of scissors. While providing a cushioning effect, this wad only minimally cushions the pressure peak accompanying the combustion of the propellant.

SUMMARY OF THE INVENTION

The present invention is concerned with a weapon with the relaxed aiming requirements of a shotgun but with the stopping power of a large caliber pistol or rifle. According to the present invention, a relatively large bore weapon, such as a shotgun, flare pistol or other hand held weapons, is provided with a special cartridge that includes, as its pay load, a plurality of curricular disks whose diameter is approximately equal to the bore of the weapon.

In an alternative embodiment, one or more disks of the stack are frangible and, upon impact with the target, can break into a plurality of smaller components, each capable of creating multiple wound channels. The disks will diverge slightly on firing from the gun and impact flatly against the target, thereby imparting a substantial impact momentum to the target. Because the disks quickly give up their force or momentum, the shock upon the target is substantial and, in the case of living targets, can incapacitate the target.

Another aspect of this invention is to provide a shotshell wad that effectively cushions the disk projectiles during the initial power surge caused by the combustion of the propellant and aids in the guiding of the projectiles down the length of the gun barrel.

An alternative embodiment of the wad includes a burn through plug that prevents the increased propellant charge from burning through the wad and eviscerating the efficiency of the sealing function of the wad.

OBJECTS OF THE INVENTION

A primary object of the invention is to provide a projectile load that impacts a target with substantial momentum that is yielded quickly. This imparts a substantial stopping force upon the target.

Another object is to provide an ammunition load for hand held weapons that combines the stopping power of large caliber projectiles with the wide area of impact of a shotgun.

A further object of the invention is to provide a projectile load which includes a plurality of circular disks which spread during flight to impact on a target with substantial momentum which is yielded quickly.

Yet another object of the invention is to provide a cartridge with a plurality of circular disks at least one of which is frangible upon impact so that after substantially all of the kinetic energy is surrendered on contact, multiple wound channels are caused by further penetration of the individual pieces of the disk.

A further object of the invention is to provide a cartridge with a plurality of circular disk, each of which has the center removed to reduce friction with air as they travel to the target.

It is yet a still further object of the invention is to provide a cartridge with improved stopping power by employing a plurality of frangible disks that quickly give up their momentum upon impact with the target and then break into many pieces, increasing the tissue tearing damage to the target.

Yet another object of the invention is to provide a cartridge with a plurality of disks of flexible or elastomeric material to impart a non lethal but debilitating shock to the target.

Still yet another object of the invention is to provide a wad for cushioning the disk projectiles from the power spike due to the combustion of the propellant.

A further object is to provide a wad that includes alignment arms that prevent the disk projectile from making contact with the sides of the shell casing or the inner diameter of the gun barrel.

A still further object is to provide a wad that cushions the initial power spike from the combustion of the propellant, includes alignment arms that prevent the contact of the disk projectiles with the barrel, and has a burn through plug the prevents the burn through of the wad by the propellant and a breach of the gas-tight seal formed by the base of the wad.

The novel features which are characteristic of the invention, both as to structure and method of operating thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWING

FIG. 5 is a perspective view of a first embodiment of a disk with a compressed center portion according to the present invention.

FIG. 6*a* and *b* is two side sectional views of a disk with a compressed central portion and illustrates the compression on one and both faces of the disk.

DETAILED DESCRIPTION OF A PREFERRED EMBODIMENT

Figure 1:
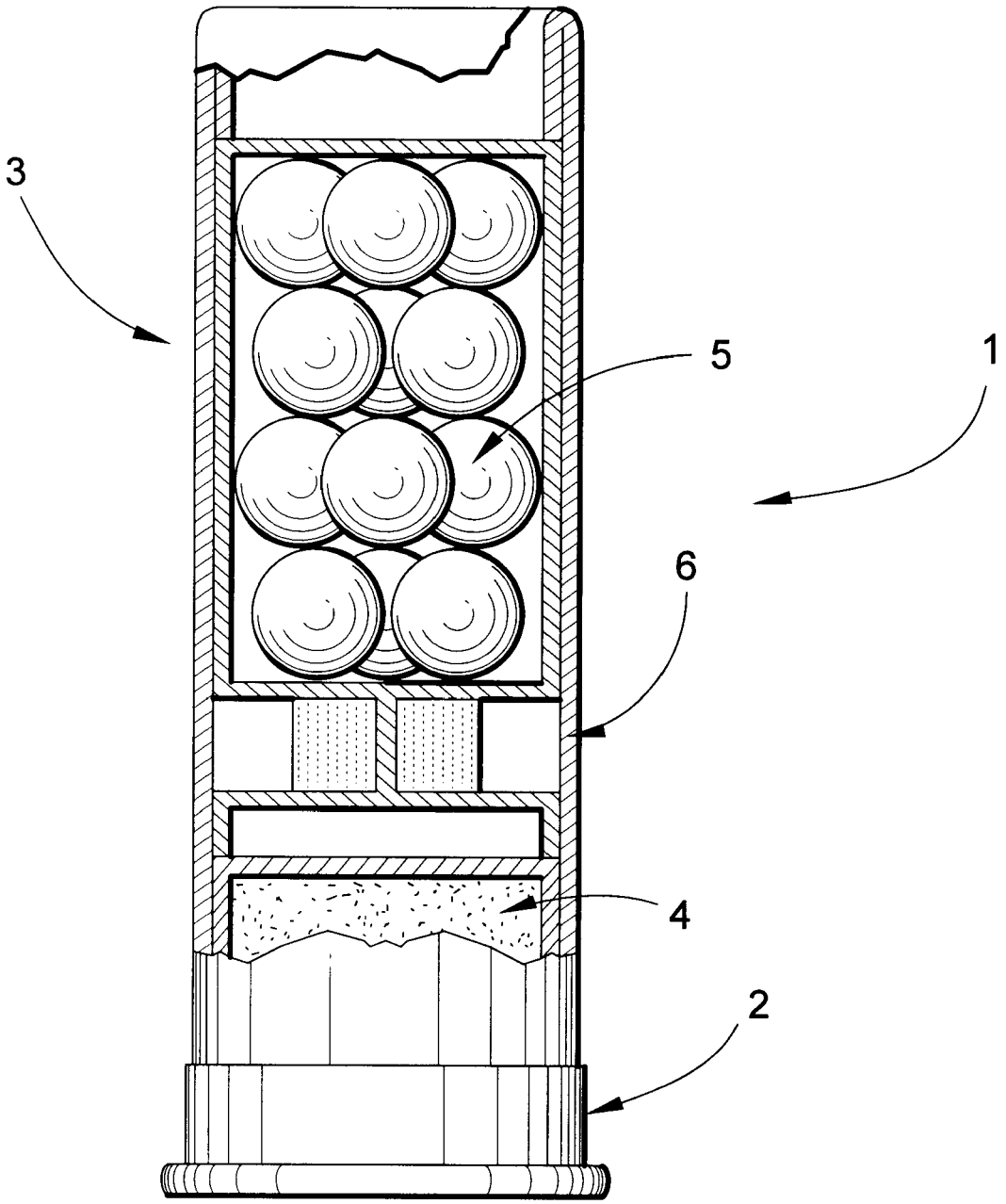
Fig. 1 (Prior Art)
FIG. 1 is a view, partly in cross section and partly in elevation, of a typical prior art shot gun shell.

FIG. 1 illustrates a typical prior art shotgun shell. A shotgun shell 1 normally consists of a shell base 2, a shell casing 3, propellant 4, a projectile mass 5, and a wad 6 interposed between the propellant 4 and the projectile mass 5. The base 2 of the shell has an aperture to receive a primer charge. With the use of some plastics, it may be necessary to provide a metallic reinforcement in the base 2. The propellant 4 is placed in the base 2 and secured with wadding 6. The projectiles are then placed over the wadding and the shell casing is crimped over a cap to secure the entire assembly.

Figure 2:
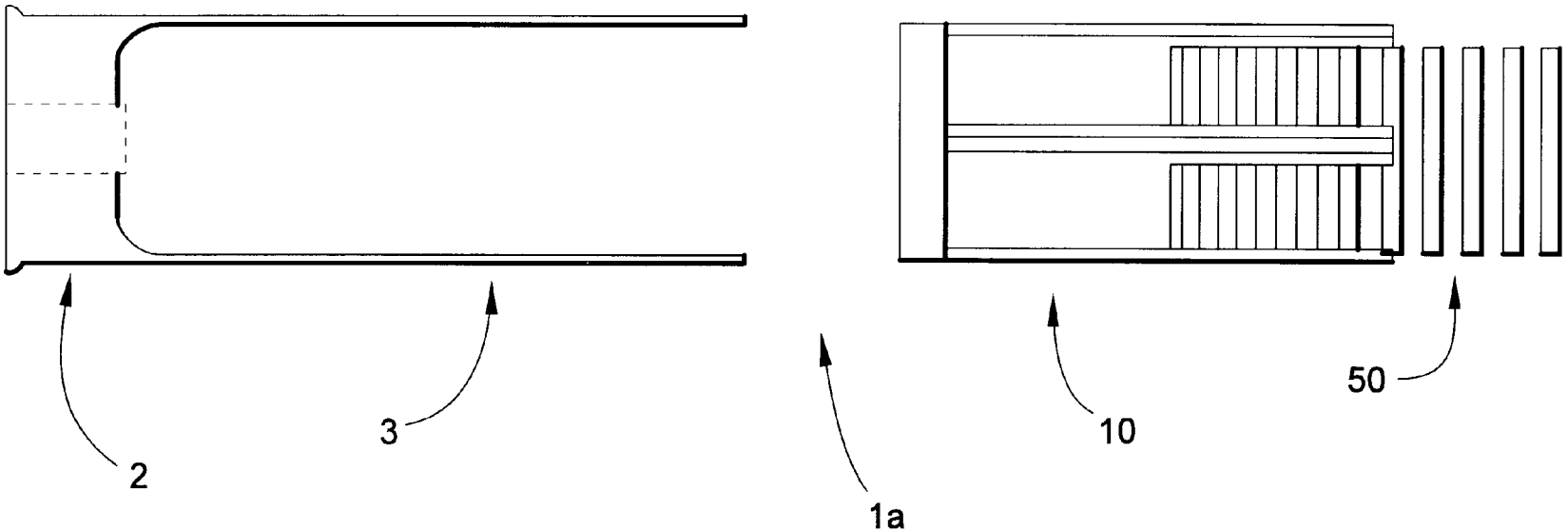
FIG. 2 is an exploded side view of an embodiment of the shell of the present invention.

In the present invention, illustrated in FIG. 2, is a shotshell la is constructed of a shell base 2, a shell casing 3, propellant 4, a plurality of stacked, circular disks 50 to form the projectile mass, and a wad 10 interposed between the propellant 4 and the plurality of stacked, circular disks 50 and are confined within the cylindrical shell casing 3 between the wad 10 and an open end of the shell 1*a*.

The circular disks 50 of the present invention each have a diameter that are at most approximately equal to an interior diameter of the shell casing 3. Alternatively, these disks may be of a diameter that is sufficiently less than the interior diameter of the shell casing 3 such that the disks do not frictionally contact the shell casing 3 or a gun barrel upon firing of the cartridge. A sealing disk or cap may be placed over the stack of disks 50 and the shell casing 3 is crimped to secure the disks 50 in place.

When the cartridge 1*a* is fired, the accelerating force of the exploding propellant 4 is directed along the axis of the disks 50. Along the flight path, the circular disks 50 will diverge approaching a target, providing a reasonably large area of impact within which the momentum of the several disks 50 can cumulatively provide a relatively greater degree of "stopping power" with substantial target upset and disruption.

Figure 3:
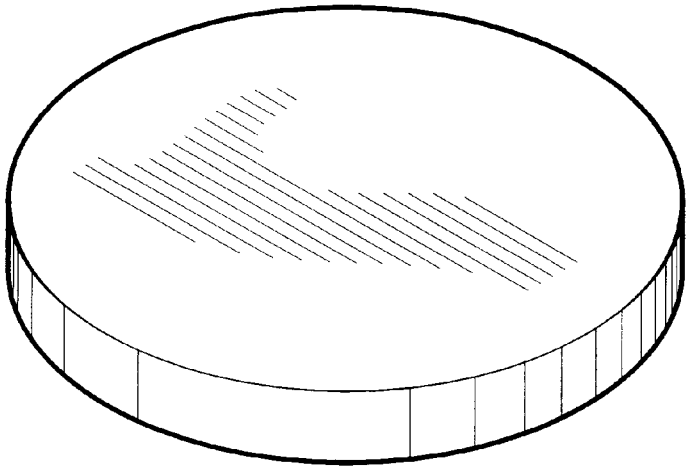
FIG. 3 is a perspective view of an ordinary disk projectile.
Figure 4:
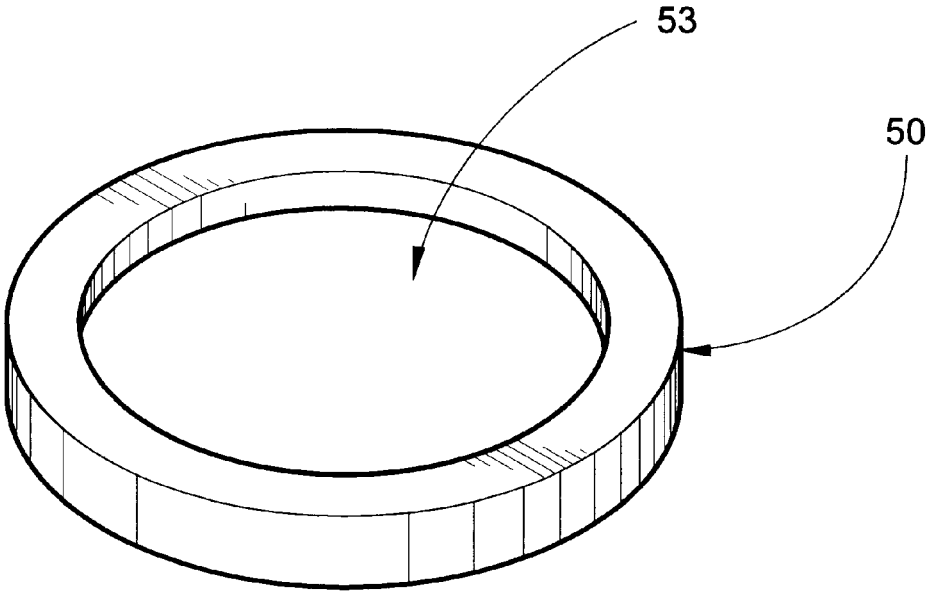
FIG. 4 is a perspective view of an alternative embodiment of a disk of the present invention with center portion removed.

FIGS. 3, 4, and 5 are perspective views of different embodiments of disks 50 according to the present invention. The embodiment shown in FIG. 4 is a flat disk 50 with a substantially centered circular depression 51 axially aligned with the center of the disk. This circular depression is preferably made by at least one anvil compressing the material of the disk thereby creating a region of higher density than in any uncompressed regions, as can be seen is FIG. 5. An interface formed by the junction between the two different densities is a structural defect that allows the disks 50 to structurally deform under impact and absorb some of the force of the impact. The compression of the projectile material may be on one side, or both sides of the disk as is illustrated in FIGS. 6*a* and 6*b*.

The embodiment shown in FIG. 4 is a flat disk 50 wherein the center 53 of the disk 50 has been removed to produce a substantially torroidally shaped projectile. This shape may be flattened to resemble a "washer". The removal of the central portion 53 of the disk 50 allows air to penetrate the disk 50, and reduce the drag on the disk 50 as it moves through the air, thus increasing it stopping power. The removal of the central portion 53 also allows portions of a body that the disk 50 impacts to interpenetrate the disk 50 and increase the disruptive potential of the shell.

The size of the disks 50 is primarily dictated by the inside diameter of the shell casing 3 in which they are placed and any minimum bore of any choke device that might be installed in the weapon. The thickness of the projectile disks 50 of the present invention, which, in the preferred embodiment is less than one eighth inch, can vary, depending upon the number of disks 50 to be used as a load and the desired size of the resulting particles. The diameter of the compressed or removed portions may vary, but it is sufficient to provide central removed or compressed portions with an area that is ½ of the area of the disk 50 in whole.

It is also within the scope of the invention to provide the projectile disks 50 with radial scoring designs. These designs vary the degree of fracture and the size and shape of the particles resulting from the fractured disk. The disks 50 are preferable made of a relatively dense material such as lead, but may equally well be composed of ceramic, plastic or even rubber or other elastomeric substances, depending upon the requirement of the situation. Alternately, the disks 50 may be made of a dense material surrounded by an elastomeric material, such as rubber clad lead disks. Clearly, such relatively soft alternative materials are preferable in crowd control situations.

Typical wads do not provide sufficient protection to the disks from the initial pressure spike produced by the combustion of the propellant. A wad structure designed to protect the disk shaped projectiles of the present invention is described below.

Figure 7:
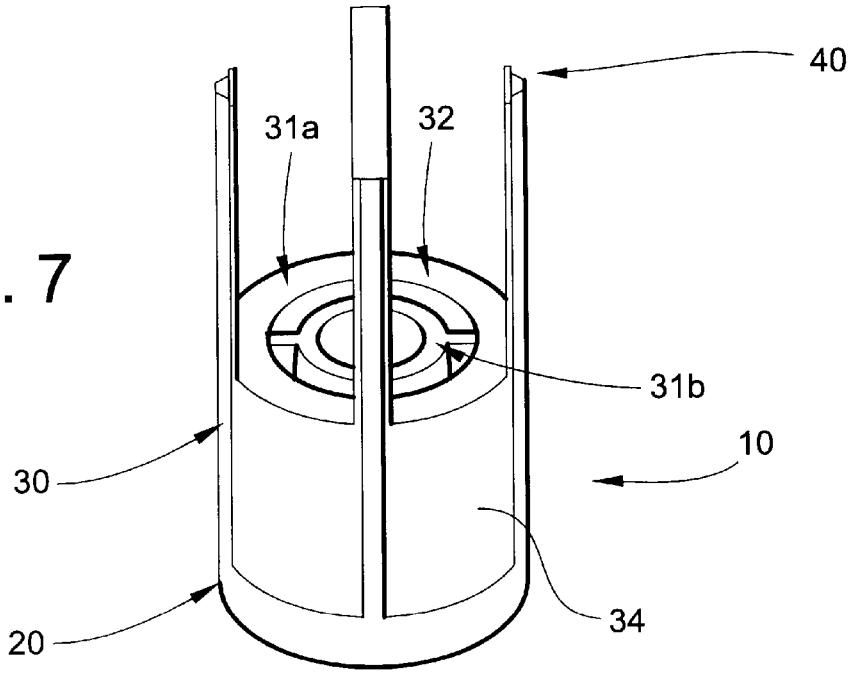
FIG. 7 is a perspective view of a combination wad and disk-centering device.
Figure 8:
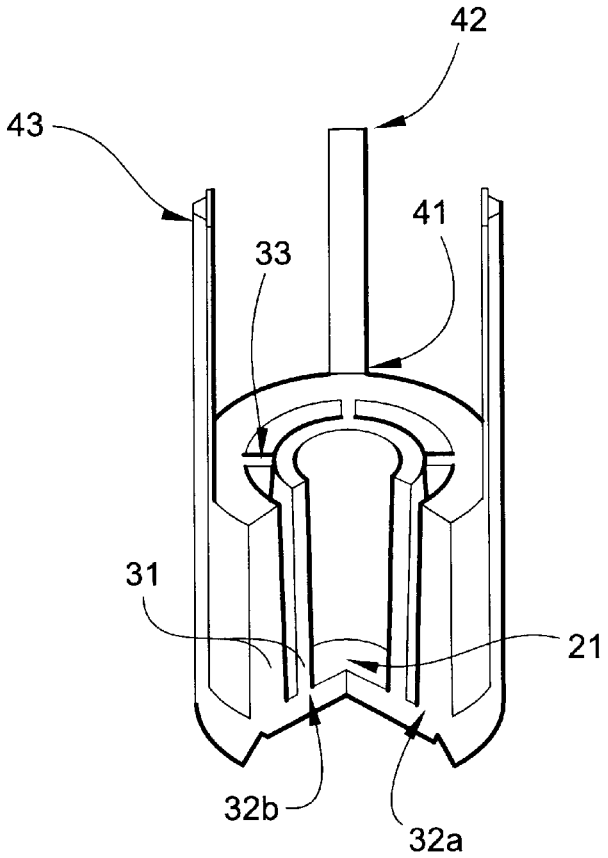
FIG. 8 is an orthorhombic view of a quarter cross section of an embodiment of the wad of this invention.
Figure 9:
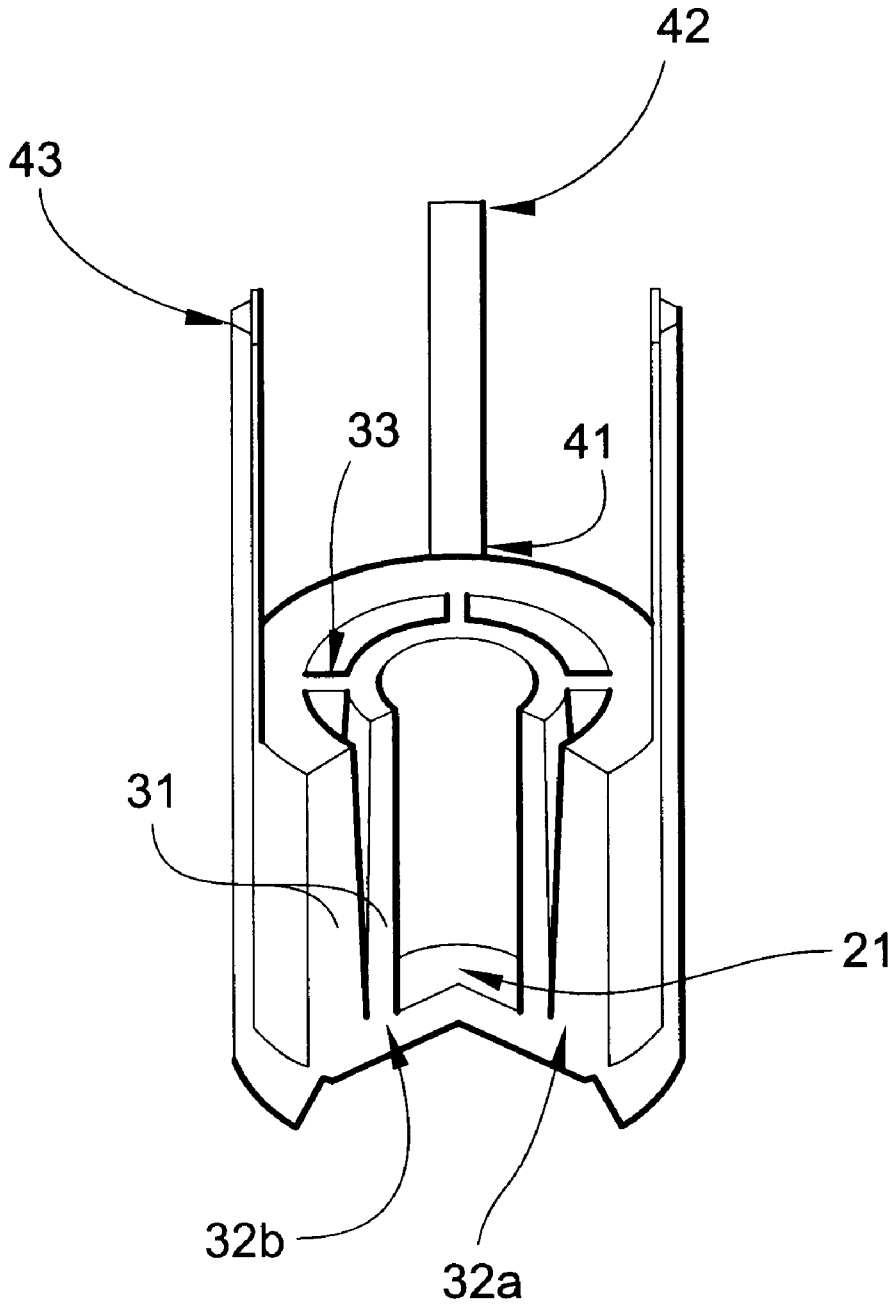
FIG. 9 is an orthorhombic view of a quarter cross section of an alternate embodiment of the wad of this invention.
Figure 10:
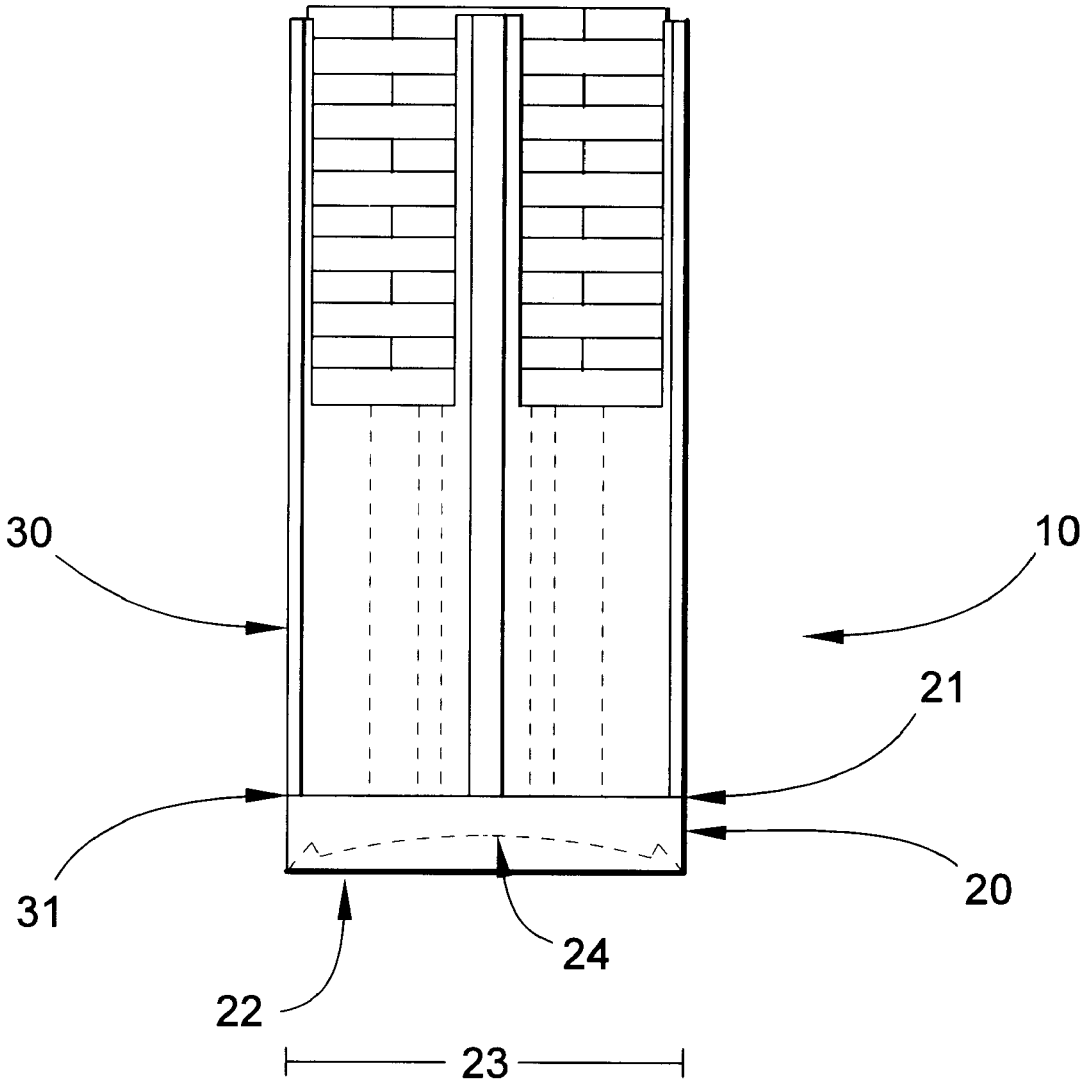
FIG. 10 is a side view of the wad and centering device of FIG. 6 with a plurality of disks according to the present invention.
Figure 11:
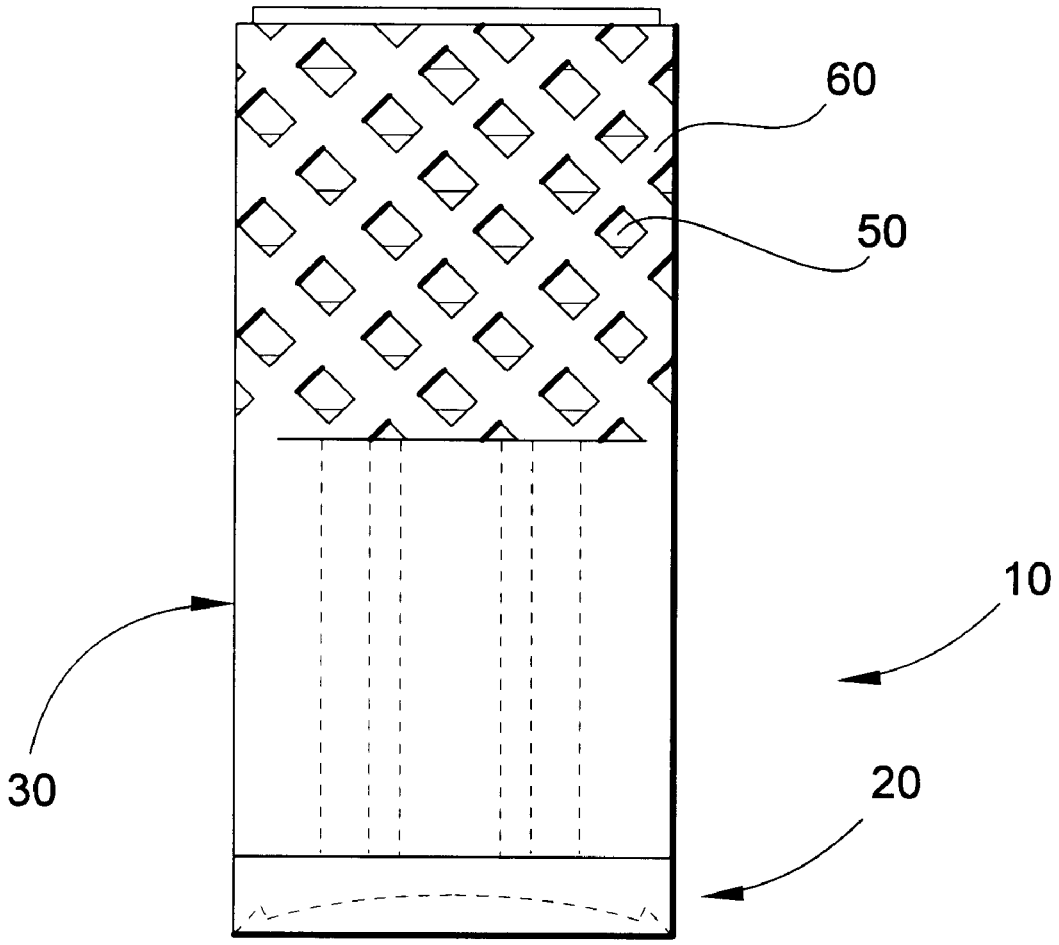
FIGS. 11*a, b*, and *c* illustrate a variety of cross sectional outlines available to the alignment arms of the present invention.

FIGS. 7, 8, and 9 illustrate the more effective cushioning wad of the present invention. The wad 10 of the present invention is typically manufactured from a polymeric plastic material, but can be made from other yieldable materials such as paper. The wad 10 consists of a wad base 20, a cushioning section 30 attached at a first end 31 to a top section 21 of the wad base 20, and at least three alignment arms 40 attached to a second end 32 of the cushioning section 30.

The wad base 20 consists of a powder cup, or piston, 22, to aid in the packing of propellant 4 in the shell 1*a*. The powder cup 22 is sized to a diameter 23 that matches the inner diameter of the shotgun casing 3. The wad base 20 also includes a burn through plug 24 placed in the powder cup 22 to prevent burn through of the wad base 20 due to high temperatures generated by the combustion of the propellant 4. Preferable the burn through plug is centered in the powder cup. Alternately, the burn through plug 24 may be place between the wad base 20 and the cushioning section 30.

The matched diameter 23 of the powder cup 22 in the wad base 20 improves the seal between the wad 10 and the shell casing 3, thus more effectively trapping the expanding gasses generated by combustion of the propellant 4. This improved trapping of the expanding gasses also increases the acceleration caused by the propellant combustion, which is needed to propel an increased projectile mass 5. The increased diameter 23 of the piston 22 also prevents the migration of propellant 4 to a section of the shell casing 3 containing the projectile mass 5. This results in a clean looking shell 1*a* when using a clear plastic material for the shell casing 3.

The cushioning section 30 is interposed between the projectile mass 50 and the wad base 20. The preferred cushioning section comprises a hollow outer cylinder 31*a* and at least one inner cylinder 31*b* of polymeric plastic material. Thus, there are at least two concentric cylinders 31*a* and 31*b* providing the cushioning between the projectile mass 50 and the expanding propellant charge 4. These at least two concentric cylinders 31*a* and 31*b* are attached at first ends 32*a* and 32*b* to the top side 21 of the wad base 20. The at least two concentric cylinders 31*a* and 31*b* are attached at an inner surface of cylinder 31*a* and at an outer surface of cylinder 31*b* by at least one attachment segment 33 to prevent any off axial movement of the at least two cylinders 31*a* and 31*b* under the acceleration caused by the combustion of the propellant 4.

The inner surface of cylinder 31*a* can be canted relative to the outer surface of cylinder 31*b* in order to facilitate the removal of the wad from any mold or die. The outer cylinder 31*a* has an outer diameter 34 that is less than the outer diameter 23 of the wad base 20. This reduced diameter 34 of the cushioning section 30 with respect to the wad base 20 eliminates any friction generated by contact of the cushioning section 30 of the wad and the inner diameter of the shell casing and the inner diameter of the gun barrel.

The wad of this invention contains at least three spatially separated alignment arms 40 having proximal ends 41 and distal ends 42 for maintaining the alignment of projectiles 50 as they travel through the gun barrel. The maintenance of projectile 50 alignment is helpful in reducing the scatter of the projectiles 50 after they exit the gun. The at least three alignment arms 40 are typically attached at the proximal ends 41 to a second end of the cushioning section 30. The geometry of the at least three alignment arms 40 is useful in the maintenance of the alignment of the projectile 50 under acceleration. A preferred embodiment is a totally symmetrical configuration. Thus when the wad 10 contains three alignment arms the arms are spaced at regular intervals of 120 degrees; four alignment arms are separated by 90 degrees; etc.

The alignment arms 40 can extend from the cushioning section 30 to the top of the shell casing 3, though it is possible to construct the alignment arms 40 of a shorter length. Alternately the alignment arms 40 may be attached to the outer diameter 34 of the outer cylinder 31*a* and extend to the top of the shell casing 3. The shape of the alignment arms 40 may vary, but is preferably flat or slightly rounded to match the curvature of the shell casing 3.

A longitudinal rib 43 is placed along the length of the wad 10 to reduce friction between the wad 10 and the shell casing 3 or gun barrel. The longitudinal rib 43 may extend from the piston or powder cup 22 to the distal ends of the alignment arms 40.

As may be seen from the figures, the alignment arms 40 of the wad 10 may have a variety of cross sectional outlines, ranging from an inverted V-shape to a T-shape with included rib to circular. In each of these outlines, it is important that the alignment arms 40 present a minimal surface for interaction with the gun barrel. Thus, the rib included on the T-shape interacts with the barrel, the vertex of the V-shape interacts with the barrel, and with the circular cross outline, the gun barrel forms a tangential surface to the curvature of the alignment arms 40.

Alternately, the wad 10 of the present invention may have a net-like structure 60 that may replace the alignment arms 43. This net-like structure 60 also functions to prevent interaction between the projectiles 50 and barrel. The net structure 60 extends from the cushioning section 30 to the top of the shell casing 3 and is adapted to receive a plurality of projectiles 50. Not only does the open structure reduce the weight of the wad 10, but also helps improve the accuracy of projectile 50 placement after firing the shell. While it is possible to integrally form the net structure 60 into the wad 10, it is also possible to secure the net 60 to the cushioning section 30 through adhesives or melt-fusion.

It should be understood that the foregoing specific components illustrated and described in the specification are not to be interpreted as limiting the scope of the invention. The breadth and depth of the overall inventive concept are deemed to be limited only by the following appended claims.

What is claimed is:

1. A wad structure comprising a. a wad base;

b. a cushioning section with an outer diameter attached to the wad base; and c. at least three spatially separated alignment arms attached to the cushioning section, said alignment arms having a significant spacing between each arm, wherein the wad base further comprises a powder cup and a burn through plug placed in the powder cup.

2. The wad structure of claim 1 wherein the wad base has an outer diameter greater than the outer diameter of the cushioning section.

3. The wad structure of claim 2 wherein the cushioning section further comprises:

c. at least two axially aligned hollow cylinders, an inner cylinder and an outer cylinder, attached to the wad base at proximate ends; and d. at least one alignment segment connecting the outer cylinder of the at least two axially aligned cylinders to the inner cylinder of the at least two axially aligned hollow cylinders.

4. The wad structure of claim 3 wherein the at least three alignment arms are attached at proximal ends of the alignment arms to a distal end of the outer cylinder of the cushioning section.

5. The wad structure of claim 1 wherein the cushioning section further comprises:

a. at least two axially aligned hollow cylinders, an inner cylinder and an outer cylinder, attached to the wad base at proximate ends; and b. at least one alignment segment connecting the outer cylinder of the at least two axially aligned cylinders to the inner cylinder of the at least two axially aligned hollow cylinders.

6. The wad structure of claim 5 wherein the at least three alignment arms are attached at proximal ends of the alignment arms to a distal end of the outer cylinder of the cushioning section.

7. The wad structure of claim 6 wherein an inner surface of the outer cylinder is canted relative to an outer surface of the inner cylinder.

8. The wad structure of claim 1 further comprising at least three longitudinal ribs attached to the outer diameter of the cushioning section, at least one of said ribs is further placed along the outer sides of each of the alignment arms.

9. The wad structure of claim 1 wherein b. a cushioning section attached to the wad base comprised of i. at least two axially aligned hollow cylinders, an inner cylinder and an outer cylinder, attached to the wad base at proximal ends; and ii. at least one alignment segment connecting the outer cylinder of the at least two axially aligned hollow cylinders to the inner cylinder of the at least two axially aligned hollow cylinders;

c. said at least three alignment arms attached at proximal ends of the aliginment arms to a distal end of the outer cylinder of the cushioning section; and d. at least three longitudinal ribs attached to the outer diameter of the cushioning section, at least one of said ribs is further placed along the outer sides of each of the alignment arms.

10. The wad structure of claim 1 wherein the cushioning section further comprises an outer cylinder and an inner cylinder, and said at least three alignment arms attached at proximal ends of the alignment arms to a distal end of the outer cylinder of the cushioning section, three attachment sections connecting the outer cylinder to the inner cylinder and spaced at approximately 120 degree intervals, the alignment arms are also spaced equally about the cushioning section at approximately 120 degree intervals, and three longitudinal ribs attached to the outer diameter of the cushioning section, at least one of said ribs is further placed along the outer sides of each of the alignment arms.

11. The wad structure of claim 1 wherein the cushioning section further comprises an outer cylinder and an inner cylinder, and there are four alignment arms attached at proximal ends of the alignment arms to a distal end of the outer cylinder of the cushioning section, four attachment sections connecting the outer cylinder to the inner cylinder and spaced at approximately 90 degree intervals, the alignment arms are also spaced equally about the cushioning section at approximately 90 degree intervals, and four longitudinal ribs attached to the outer diameter of the cushioning section, at least one of said ribs is further placed along the outer sides of each of the alignment arms.

12. A wad structure comprising a. a wad base comprises a powder cup and a burn through plug placed in the powder cup;

b. a cushioning section with an outer diameter attached to the wad base; and c. a net structure attached to the cushioning section, said net structure adapted to receive a plurality of projectiles and cushion said plurality of projectiles as said plurality of projectiles travel the length of a gun barrel.

* * * * *